US006107987A

United States Patent [19]

Coelho

[11] Patent Number: 6,107,987

[45] **Date of Patent: *Aug. 22, 2000**

[54] APPARATUS FOR TABLE-DRIVEN CONVERSION OF PIXELS FROM YVU TO RGB FORMAT

[75] Inventor: Rohan Coelho, Hillsboro, Oreg.

[73] Assignee: Intel Corporation, Santa Clara, Calif.

[ * ] Notice: This patent is subject to a terminal disclaimer.

[21] Appl. No.: 09/059,052

[22] Filed: Apr. 13, 1998

Related U.S. Application Data

[63] Continuation of application No. 08/828,003, Mar. 27, 1997, which is a continuation of application No. 08/236,230, Apr. 29, 1994, abandoned.

[51] Int. Cl.[7] ..... G09G 5/04; G09G 5/06

[52] U.S. Cl. ..... 345/154; 345/199

[58] Field of Search ..... 345/153, 154, 345/199; 395/890; 348/472, 488; 358/523

[56] References Cited

U.S. PATENT DOCUMENTS

| | | | |
|---|---|---|---|
| 4,758,885 | 7/1988 | Sasaki et al. | 358/520 |
| 4,942,457 | 7/1990 | Keesen et al. | 348/566 |
| 4,954,970 | 9/1990 | Walker et al. | 5/135 |
| 4,991,122 | 2/1991 | Sanders | 395/131 |
| 5,313,226 | 5/1994 | Takakura et al. | 345/115 |
| 5,329,292 | 7/1994 | Nishioka et al. | 345/199 |
| 5,381,180 | 1/1995 | Keith | 348/396 |
| 5,384,582 | 1/1995 | Keith et al. | 345/199 |
| 5,821,919 | 10/1998 | Coelho | 345/154 |
| 5,963,263 | 10/1999 | Shyu | 348/453 |
| 5,990,876 | 11/1999 | Shyu | 345/199 |

*Primary Examiner*—Vijay Shankar
*Assistant Examiner*—Jeff Piziali
*Attorney, Agent, or Firm*—Duane, Morris & Heckscher LLP

[57] ABSTRACT

An apparatus for converting digital video pixels from YVU format to RGB format includes first, second and third registers each of which is coupled to computer memory by a data bus. The computer memory has a plurality of tables and a plurality of YVU pixels stored therein. A controller is coupled to the registers and to the computer memory by the data bus. The controller converts pixels in YVU format to RGB format by performing a plurality of table look-up operations on the YVU pixels.

5 Claims, 2 Drawing Sheets

APPARATUS FOR TABLE-DRIVEN CONVERSION OF PIXELS FROM YVU TO RGB FORMAT

This application is a continuation of Ser. No. 08/828,003 filed Mar. 27, 1997, which is a continuation of Ser. No. 08/236,230 filed Apr. 29, 1994, now abandoned.

FIELD OF THE INVENTION

This invention relates to video signal processing generally and particularly to systems for providing a decompressed digital video signal representative of a full color motion video signal.

BACKGROUND OF THE INVENTION

During playback of digital video images, pixels stored in YVU format typically must be converted to RGB format in order to be displayed. Known processes for converting pixels from YVU to RGB format require the solution of the following three equations which together include several multiplications:

$$R = 1.164 * Y + 1.596 * (V - 128) \quad (1)$$

$$G = 1.164 * Y + 0.813 * (V - 128) - 0.396 * (U - 128) \quad (2)$$

$$B = 1.164 * Y + 2.017 * (U - 128) \quad (3)$$

Many microprocessors perform multiplications relatively slowly. By contrast, many microprocessors are able to perform table accesses much more quickly than multiplications.

It is an object of the present invention to speed-up the process of converting pixels from YVU to RGB format by replacing multiplications in the pixel conversion process with table look-ups.

Further objects and advantages of the invention will become apparent from the description of the invention which follows.

SUMMARY OF THE INVENTION

An apparatus for converting digital video pixels from YVU format to RGB format includes first, second and third registers each of which is coupled to computer memory by a data bus. The computer memory has a plurality of tables and a plurality of YVU pixels stored therein. A controller is coupled to the registers and to the computer memory by the data bus. The controller includes means for respectively loading Y and V component information into the first and second registers, and first look-up means for looking-up the contents of the second register in a first table and loading the result into the third register. Second look-up means are provided for looking-up the sum of the first and third registers in a second table and loading the result into the third data register, and third lookup means are provided for looking-up the contents of the second register in a third table and loading the third register with the result. The controller also includes means for reloading the second register with U component information. Fourth look-up means are provided for looking-up the value of the reloaded second register in a fourth table and loading the sum of the result of the fourth table look-up and the third register into the third register. Fifth look-up means are provided for looking-up in a fifth table the sum of the first and third registers and loading the result into the third data register. Sixth look-up means are provided for looking-up the second register in a sixth table and loading the result into the third register, and seventh look-up means are provided for looking-up in a seventh table the sum of the first and third data registers. The results of the second, fifth and seventh look-up means respectively represent the R, G and B components of a video pixel corresponding to the Y, V, and U component information.

DETAILED DESCRIPTION OF THE PREFERRED EMBODIMENT

Figure 1:
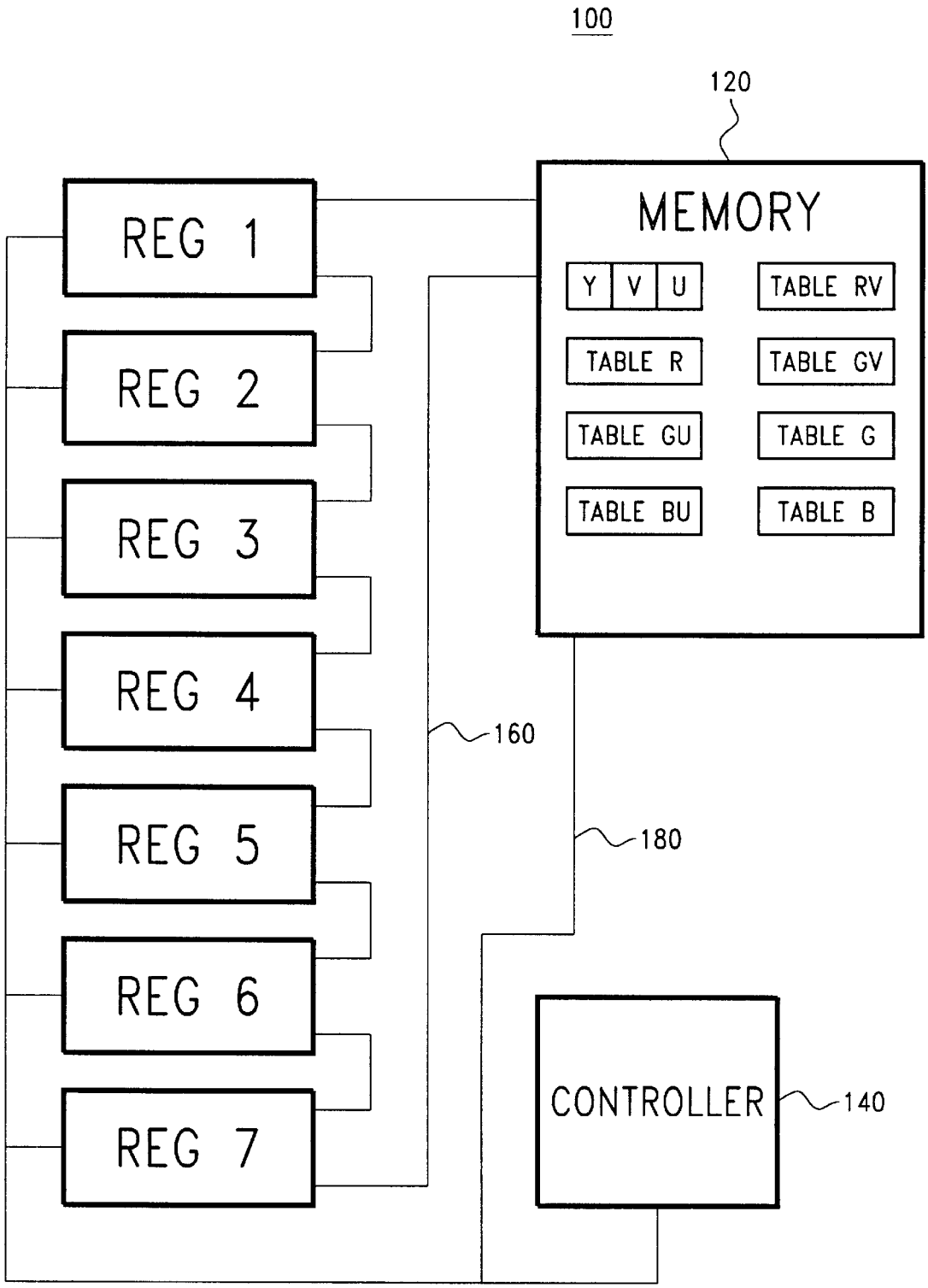
FIG. 1 is a hardware block diagram of a system for converting YVU pixels to RGB format in accordance with the preferred embodiment of the present invention.

Referring now to FIG. 1, there is shown a hardware block diagram of a system 100 for converting YVU pixels to RGB format in accordance with the preferred embodiment of the present invention. System 100 includes seven general purpose registers REG1, REG2, REG3, REG4, REG5, REG6 and REG7. Each of the general purpose registers is coupled to computer memory 120 by data bus 160. A plurality of YVU pixels are stored in memory 120. A controller 140 for directing the conversion of YVU pixels stored in memory 120 is also provided. Controller 140 is coupled to memory 120 and the general purpose registers by control bus 180.

Figure 2:
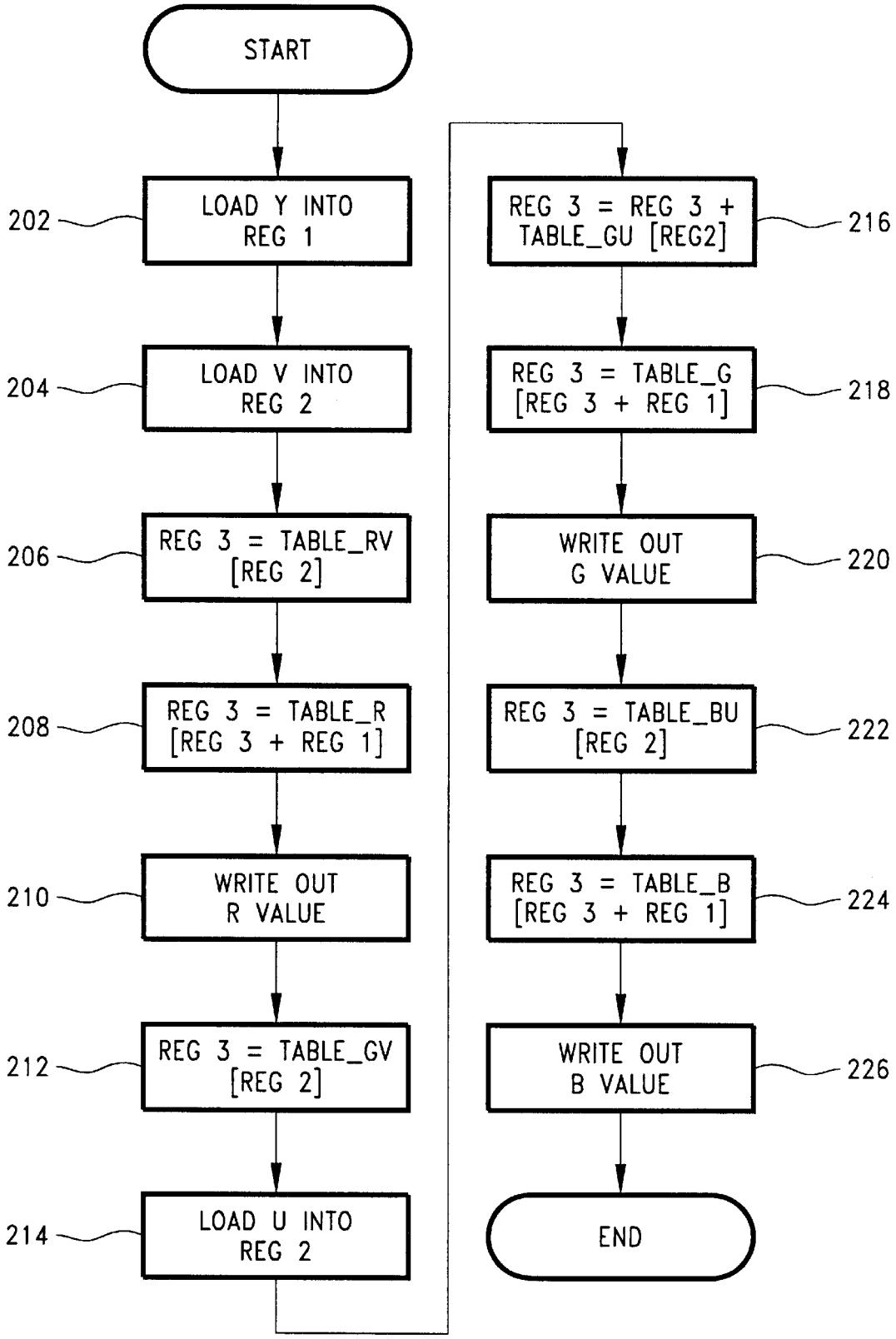
FIG. 2 is flow diagram showing the operation of a controller for converting YVU pixels to RGB format in accordance with the preferred embodiment of the present invention.

Referring now to FIG. 2, there is shown a flow diagram illustrating the operation of controller 140 for converting YVU pixels to RGB format in accordance with the preferred embodiment of the present invention. Controller 200 includes a first register loading means 202 for loading REG1 with the Y value of the YVU pixel being converted to RGB format. Controller 200 further includes a second register loading means 204 for loading REG2 with the V value of the YVU pixel being converted to RGB format. First table look-up means 206 are provided for looking-up the value of REG2 (as loaded by second register loading means 204) in a first table (TABLE_RV) and loading the result of the first table look-up into REG3. Each entry in TABLE_RV maps an 8-bit V value to (1.596/1.164)*V. TABLE_RV preferably includes 256 8-bit entries. Second table look-up means 208 are provided for looking-up the sum of REG1 (as loaded by first register loading means 202) and REG3 (as loaded by first table look-up means 206) in a second table (TABLE_R) and loading the result of the second table look-up into REG3. Each entry in TABLE R maps the quantity (Y+(1.596/1.164*V)) to 1.64*Y+(V*(1.596/1.164))−((128*1.596)/1.164). TABLE_R preferably includes 512 8-bit entries. Output means 210 are provided for outputting REG3 (as loaded by second table look-up means 208). The value output by means 210 corresponds to the R value of the YVU pixel being converted to RGB format.

Referring still to FIG. 2, third table look-up means 212 are provided for looking-up the value of REG2 (as loaded by second register loading means 204) in a third table (TABLE_GV) and loading REG3 with the result of the third table look-up. Each entry in TABLE_GV maps an 8-bit V value to −(0.813*V)/1.164. TABLE_GV preferably includes 256 8-bit entries. Register reloading means 214 are provided for reloading REG2 with the U component of the YVU pixel being converted to RGB format. Fourth table look-up means 216 are provided for looking-up the value of REG2 (as reloaded by reloading means 214) in a fourth table (TABLE_GU) and loading the sum of the result of the fourth table look-up and REG3 (as loaded by third table look-up means 212) into REG3. Each TABLE_GU entry maps an 8-bit U value to 0.396*U/1.164. TABLE_GU preferably includes 256 16-bit entries. Fifth table look-up means 218 are provided for looking-up in a fifth table (TABLE_G) the sum of REG1 (as loaded by first register loading means 202) and REG3 (as loaded by fourth table look-up means 216) and loading the result of the fifth table look-up into REG3. Each value in TABLE_G maps (Y+(0.813*V/1.164)−(0.396*U/1.164)) to ((1.164*Y)+(0.813*(V-128))−(0.396*(U-128))). TABLE_G preferably includes 512 8-bit entries. Output means 220 are provided for outputting REG3 (as loaded by fifth table look-up means 218). The value output by means 220 corresponds to the G value of the YVU pixel being converted to RGB format.

Referring still to FIG. 2, sixth table look-up means 222 are provided for looking-up the value of REG2 (as reloaded by register reloading means 214) in a sixth table (TABLE_BU) and loading the result of the sixth table look-up into REG3. Each entry in TABLE_BU maps an 8-bit U value to 2.017*U/1.164. TABLE_BU preferably includes 256 8-bit entries. Seventh table look-up means 224 are provided for looking-up in a seventh table (TABLE_B) the sum of REG1 (as loaded said first register loading means 202) and REG3 (as loaded by sixth table look-up means 222) and loading the result of the seventh table look-up into REG3. Each entry in TABLE_B maps (Y+(2.017*U/1.164)) to ((1.164*Y)+(2.017*(U-128))). TABLE_B preferably includes 512 8-bit entries. Output means 226 are provided for outputting REG3 (as loaded by seventh table look-up means 224). The value output by means 220 corresponds to the B value of the YVU pixel being converted to RGB format. In the preferred embodiment, tables TABLE_RV, TABLE_R, TABLE_RV, TABLE_GU, TABLE_G, TABLE_BU, and TABLE_B reside are stored in computer memory 120.

In the preferred embodiment of the present invention, REG1, REG2 and REG3 are the only general purpose registers used to accomplish the table look-up operations employed in the pixel conversion process, thereby leaving the other four general purpose registers of system 100 available for other uses. In the preferred embodiment, one of these other general purposes registers (REG4) is used to hold a pointer to the Y data loaded into REG1 by first register loading means 202. In addition, REG5 is preferably used as a destination register used for outputting the R, G and B values corresponding to the YVU pixel being converted. In the preferred embodiment of the present invention, the YVU pixels being converted are stored in memory 120 in 4:1:1 format. Thus, for each block of 4 YVU pixels, there will be 4 Y samples, 1 V sample, and 1 U sample stored in memory 120. In order to determine a V value and a U value corresponding to each of the 4 Y samples, the V and U data must be linearly interpolated for each corresponding Y sample. In order to facilitate the interpolation process, the two 8-bit U and V samples corresponding to the block of YVU pixels being converted to RGB format are stored in REG6 until all interpolations have been completed for the block of YVU pixels being processed. REG6 is preferably at least 16 bits wide. Finally, in the preferred embodiment, REG7 is used during the pixel conversion process as a stride register.

The present invention is preferably implemented using an Intel model 286, 386 or 486 processor, although a general purpose processor may also be used. The present invention may be embodied in other specific forms without departing from the spirit or essential attributes of the invention. Accordingly, reference should be made to the appended claims, rather than the foregoing specification, as indicating the scope of the invention.

What is claimed is:

1. An apparatus for converting digital video pixels from YVU format to RGB format, the apparatus comprising:

(a) a plurality of data registers comprising first, second, and third data registers;

(b) computer memory coupled to said plurality of data registers by a data bus, said computer memory having a plurality of tables stored therein, said computer memory for providing a pixel in YVU format, said YVU pixel having separate Y, V, and U components; and (c) a controller coupled to said plurality of data registers and to said computer memory by said data bus, said controller comprising:

(i) means for loading said plurality of data registers with said Y, V, and U components;

(ii) means for retrieving values from said plurality of stored tables; and (iii) means for generating values representing R, G, and B components of a digital video pixel corresponding to said Y, V, U pixel by accessing said stored tables using said Y, V and U components as indices.

2. The apparatus of claim 1, wherein:

said controller is coupled to said first, second and third data registers and to said computer memory by said data bus; and means (c)(i)–(iii) comprise:

(1) means for loading said Y component into said first data register, (2) means for loading said V component into said second data register;

(3) means for looking-up in a first table the value of said loaded second data register to obtain a first result and for loading the first result into said third data register;

(4) means for looking-up in a second table the sum of said loaded first data register and said loaded third data register to obtain a second result;

(5) means for looking-up in a third table the value of said loaded second data register to obtain a third result and for loading said third data register with the third result;

(6) reloads said second data register with said U component;

(7) means for looking-up in a fourth table the value of said reloaded second data register to obtain a fourth result and for loading the sum of said fourth result and said third data register as loaded by said controller into said third data register;

(8) means for looking-up in a fifth table the sum of said loaded first data register and said third data register as loaded by said controller to obtain a fifth result;

(9) means for looking-up in a sixth table the value of said reloaded second data register to obtain a sixth result and for loading the sixth result into said third data register; and

(10) means for looking-up in a seventh table the sum of said loaded first data register and said third data register as loaded by said controller to obtain a seventh result; wherein the second, fifth and seventh results respectively represent R, G, and B components of a digital video pixel corresponding to said YVU pixel.

3. The apparatus of claim 1, further comprising a fourth data register for storing pointer information corresponding to the address of said Y component in said computer memory.

4. The apparatus of claim 3, further comprising a fifth data register for storing information representative of said V and U components.

5. The apparatus of claim 3, further comprising a sixth data register used as a destination register for outputting said R, G and B components of said digital video pixel corresponding to said YVU pixel.

* * * * *